US007213961B2

(12) United States Patent
Hyder

(10) Patent No.: US 7,213,961 B2
(45) Date of Patent: May 8, 2007

(54) LOW VOLTAGE LUMINAIRE ASSEMBLY

(75) Inventor: LaShannon S. Hyder, Greer, SC (US)

(73) Assignee: Hubbell Incorporated, Orange, CT (US)

( * ) Notice: Subject to any disclaimer, the term of this patent is extended or adjusted under 35 U.S.C. 154(b) by 53 days.

(21) Appl. No.: 10/617,041

(22) Filed: Jul. 11, 2003

(65) Prior Publication Data

US 2005/0007031 A1 Jan. 13, 2005

(51) Int. Cl.
*F21V 7/04* (2006.01)

(52) U.S. Cl. ..... 362/655; 362/227; 362/457; 439/441

(58) Field of Classification Search ..... 362/226–227, 362/429–430, 433, 457, 252, 640, 647, 652, 362/655–659; 439/440–441
See application file for complete search history.

(56) References Cited

U.S. PATENT DOCUMENTS 1,347,737 A * 7/1920 Douglas ..... 326/226
2,617,844 A * 11/1952 Sanda ..... 439/441
2,713,668 A * 7/1955 Gibilisco ..... 439/438
2,720,634 A * 10/1955 Hart ..... 439/441
2,946,977 A * 7/1960 Sheldon ..... 439/441
3,231,731 A * 1/1966 McDonald ..... 362/226
4,104,606 A * 8/1978 DeWitt ..... 338/198
4,234,915 A * 11/1980 Malinowski et al. ..... 362/252
4,241,387 A * 12/1980 Bowers ..... 362/252
4,300,188 A * 11/1981 Addario ..... 362/485
4,482,944 A * 11/1984 Roossine et al. ..... 362/418
4,532,579 A * 7/1985 Merryman ..... 362/239
4,566,749 A * 1/1986 Johnston ..... 439/441
4,631,650 A * 12/1986 Ahroni ..... 362/249
4,639,841 A * 1/1987 Salestrom et al. ..... 362/227
4,655,520 A * 4/1987 Cummings ..... 439/111
4,713,019 A * 12/1987 Gaynor ..... 439/232
4,759,726 A * 7/1988 Naylor et al. ..... 439/441
4,821,162 A * 4/1989 Ellis ..... 362/408
4,828,505 A * 5/1989 Shwisha ..... 439/119
4,835,915 A * 6/1989 Nilssen ..... 52/28
4,855,646 A * 8/1989 Peckitt et al. ..... 315/175

(Continued)

OTHER PUBLICATIONS

Hatch Transformers, Electronic Transformers, Jan. 1999, http://www.hatchtransformers.com/prodpage/vs/index.asp (pp. 1-3), http:www.hatchtransformers.com/prodpage/vs150/index.asp (p. 4-6), http://www.hatchtransformers.com/prodpage/ps/index.asp (p. 7-9).*

*Primary Examiner*—Sandra O'Shea
*Assistant Examiner*—Jason Moon Han
(74) *Attorney, Agent, or Firm*—Marcus R. Mickney; Mark S. Bicks; Alfred N. Goodman

(57) ABSTRACT

A low-voltage luminaire assembly is provided with a transformer and a lamp holder, one or more of which have quick-release connections. Methods for installing and servicing the luminaire assembly are also provided. The luminaire assembly may also have a plurality of lamp holders, a plurality of input and output electrical wires, a rotary dimmer switch, and an electrical plug component. The transformer and lamp holders are mounted to an object and the electrical wires are tailored to the necessary installation dimensions, thereby providing a luminaire assembly that is easily and neatly installable to any object in any desired configuration.

55 Claims, 4 Drawing Sheets

U.S. PATENT DOCUMENTS 4,855,882 A * 8/1989 Boss ..... 362/238
4,979,081 A * 12/1990 Leach et al. ..... 362/219
4,996,636 A * 2/1991 Lovett ..... 362/226
5,029,057 A * 7/1991 Devir et al. ..... 362/226
5,034,865 A * 7/1991 Sonneman ..... 362/226
5,045,981 A * 9/1991 Nagano ..... 362/219
5,065,292 A * 11/1991 Aubrey ..... 362/260
5,102,348 A * 4/1992 Chou ..... 439/441
5,109,324 A * 4/1992 Ahroni ..... 362/249
5,150,964 A * 9/1992 Tsui ..... 362/251
5,154,508 A * 10/1992 Ahroni ..... 362/226
5,158,360 A * 10/1992 Banke ..... 362/391
5,203,626 A * 4/1993 Clement ..... 362/250
5,292,260 A * 3/1994 Sinisi et al. ..... 439/441
5,321,592 A * 6/1994 Marinacci ..... 362/226
5,330,368 A * 7/1994 Tsuruzono ..... 439/409
5,339,232 A * 8/1994 Lin ..... 362/391
5,426,572 A 6/1995 Weinstock et al.
5,455,754 A * 10/1995 Hoffner ..... 362/250
5,637,017 A * 6/1997 Hsu ..... 439/622
5,738,436 A * 4/1998 Cummings et al. ..... 362/294
5,785,411 A * 7/1998 Komai et al. ..... 362/219
5,833,358 A * 11/1998 Patik ..... 362/391
5,957,564 A * 9/1999 Bruce et al. ..... 362/84
6,089,884 A * 7/2000 Klaus ..... 439/117
6,227,687 B1 * 5/2001 Kahwaji ..... 362/391
6,261,120 B1 * 7/2001 Beege et al. ..... 439/441
6,283,612 B1 * 9/2001 Hunter ..... 362/240
6,290,365 B1 * 9/2001 Schlesinger ..... 362/84
6,431,722 B1 8/2002 Benensohn
6,438,983 B1 8/2002 Zellner et al.
6,491,413 B1 12/2002 Benesohn
6,505,950 B1 * 1/2003 Natoli et al. ..... 362/146
6,508,566 B1 1/2003 Roorda
6,533,437 B1 * 3/2003 Ahroni ..... 362/249
6,648,492 B1 * 11/2003 Shih ..... 362/397
6,648,498 B1 * 11/2003 Tsao ..... 362/235
6,719,581 B2 * 4/2004 Kikuchi ..... 439/441
6,726,344 B2 * 4/2004 Lee ..... 362/250
6,793,369 B2 * 9/2004 Calzaretta et al. ..... 362/219
6,794,830 B2 * 9/2004 Lansing et al. ..... 315/291
6,808,289 B2 * 10/2004 Reed ..... 362/198
6,814,462 B1 * 11/2004 Fiene ..... 362/133
2002/0093819 A1 * 7/2002 Chen et al. ..... 362/226
2002/0106931 A1 * 8/2002 Hsien-Te ..... 439/490

* cited by examiner

LOW VOLTAGE LUMINAIRE ASSEMBLY

FIELD OF THE INVENTION

The present invention relates to a low voltage luminaire assembly. More particularly, the present invention relates to a low-voltage luminaire assembly having a quick-release transformer and at least one quick-release lamp holders that are mountable to a surface. Still more particularly, the present invention relates to a method of installing, removing and replacing components of a low voltage luminaire assembly.

BACKGROUND OF THE INVENTION

Light fixtures are used in homes and buildings to provide various forms of illumination. Some light fixtures serve both functional and aesthetic purposes, such as for illumination of work surfaces below cabinets and in cabinetry and furniture in constricted areas.

In one form, strings of low-voltage accent lights are provided as part of an under-cabinet installation kit to be used by builders or by after-market consumers. These under-cabinet lights are typically mounted to surfaces under kitchen cabinetry or recessed into shelf portions of cabinets to provide additional lighting for countertops. Such under-cabinet lights often use tracks or "raceways" that are used to mount individual lamp assemblies. Electrical wires are routed in the raceways. The lamp assemblies typically pierce the electrical wires when the lamp assemblies are mounted to the raceways.

Conventional under-cabinet lights suffer from various drawbacks. For instance, their raceways are usually made of a rigid material with a fixed orientation such as a straight line, which limits orientation of the under-cabinet lights. Since the raceways must be measured and cut to fit specific surfaces, installation of known under-cabinet lights can be time-consuming. Also, if a raceway is measured incorrectly, additional time and materials are wasted. Furthermore, if an electrical wire is pierced incorrectly when installing individual lamp assemblies on the raceway, the entire under-cabinet light may have to be replaced. Moreover, failure of a transformer supplied with some under-cabinet lights to convert 120 volts to 12 volts usually requires replacement of the entire under-cabinet light.

A modular, quick-release, under-cabinet luminaire assembly is desirable that is easily installed and serviced.

SUMMARY OF THE INVENTION

The present invention provides a low-voltage, under-cabinet lighting fixture or luminaire assembly for permanent or temporary and surface or recessed mounting. In general, the luminaire assembly is low-profile and modular with quick-release electrical connections to connect individual lamp assemblies and a transformer to objects quickly and easily. Further, the component parts of the modular luminaire assembly are simple, reliable, and economical to manufacture and use.

In one aspect of the invention, a luminaire assembly is provided with a transformer, a plurality of lamp holders, a plurality of input and output electrical wires, a rotary dimmer switch, and an electrical plug component. The transformer and the plurality of lamp holders have respective supply and output apertures with quick-release electrical connections for the electrical wires. The transformer and lamp holders are prearranged to evaluate functional and aesthetic requirements, for instance, in an under-cabinet area. Once these requirements are satisfied, the transformer and lamp holders are adhesively or mechanically attached to the under-cabinet area, and the electrical wires are tailored to the necessary installation dimensions.

In another aspect of the invention, a method is disclosed for installing a luminaire assembly similar to the foregoing embodiment. The method includes the steps of fitting the transformer and lamp holders to an area; tailoring the electrical wires to the dimensions of the area; attaching the transformer and lamp holders to the area; inserting the electrical wires in the transformer and lamp holders via quick-release connections; inserting a plurality of bulbs in the lamp holders; and connecting the luminaire assembly to a source of electrical power.

In a further aspect of the invention, a method is disclosed for selectively removing and replacing components of a luminaire assembly similar to the foregoing embodiment. The method includes the steps of disconnecting the luminaire assembly from a source of electrical power; releasing electrical wires from one of a transformer and a lamp holder via quick-release connections; removing one of the transformer and lamp holders from an installation area; attaching one of a new transformer and new lamp holders in the installation area; reinserting the electrical wires in one of the new transformer and lamp holders and reconnecting the luminaire assembly to the electrical power source. Further steps may include attaching additional lamp holders to the luminaire assembly; replacing the transformer with a higher rated transformer; adjusting positions of one of the transformer and lamp holders; and inserting a plurality of bulbs in the new lamp holders.

Other objects, advantages and salient features of the invention will become apparent from the following description, which, taken in conjunction with the annexed drawings, discloses preferred embodiments of the invention.

BRIEF DESCRIPTION OF THE DRAWINGS

Referring now to the drawings that form a part of this original disclosure.

The detailed description below uses numerical and letter designations to refer to features in the drawings. Like or similar designations in the drawings and description have been used to refer to like or similar parts of the invention.

DETAILED DESCRIPTION OF THE INVENTION

Figure 1:
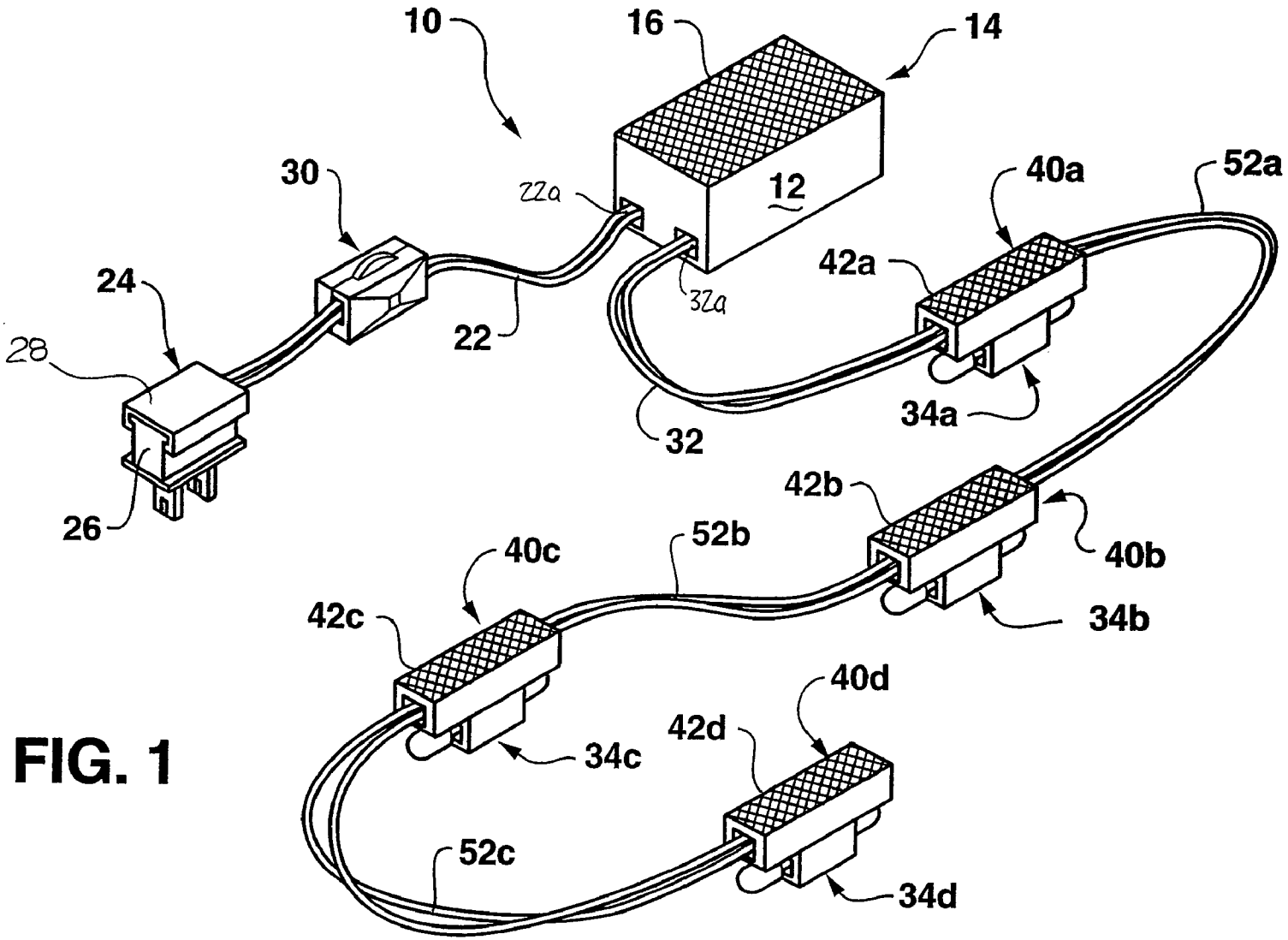
FIG. 1 is a top perspective view of a luminaire assembly in accordance with a first embodiment of the present invention.

Detailed reference will now be made to the drawings in which examples embodying the present invention are shown. The drawings and detailed description provide a full and detailed written description of the invention, and of the manner and process of making and using it, so as to enable one skilled in the pertinent art to make and use it, as well as the best mode of carrying out the invention. However, the embodiments set forth in the drawings and detailed description are provided by way of explanation of the invention only and are not meant as limitations of the invention. The present invention thus includes any modifications and variations of the following examples as come within the scope of the appended claims and their equivalents.

It is also to be understood that references herein to such terms as "top," "bottom," and "side" of objects or surfaces are intended solely for purposes of providing an enabling disclosure, and in no way suggest limitations regarding the operative orientation of the luminaire assembly 10 or any components thereof.

As broadly embodied in FIGS. 1–4, a low-voltage luminaire assembly is provided with a quick-release transformer and a plurality of quick-release lamp holders. The transformer and the plurality of lamp holders are temporarily or permanently mountable to a surface or recessed area, such as an under-cabinet kitchen area, during original construction or as an after-market installation. Embodiments of applications and operations of the transformer, the lamp holders, and their quick-connect/quick-release mechanisms are described below.

An under-cabinet lighting fixture or luminaire assembly 10, according to a first embodiment of the present invention, is shown in FIG. 1. The luminaire assembly 10 has a transformer 12, an electrical plug component 24, a rotary dimmer switch 30, and a plurality of lamp holders 34*a*–*d*. The transformer 12 has a mounting side 14 that is attachable to a surface area (not shown). A double-sided adhesive tape 16 may be used to mount the transformer 12, but the transformer may be mounted in any suitable manner. Similarly, the plurality of lamp holders 34*a*–*d* have respective mounting sides 40*a*–*d* attachable by double-sided adhesive tape 42*a*–*d*. In this example, a wax-type paper (not shown) is peeled away from the mounting sides 14 and 40*a*–*d* to expose the respective adhesive tapes 16 and 42*a*–*d* for adherence to the surface area. However, any attachment mechanism may be substituted for the double-sided adhesive tape 16, 42*a*–*d*, such as other forms of adhesive, screws, bolts, nails, nuts, rivets, pins, snap-fittings, press-fittings, and the like. Another suitable attachment mechanism is described below with respect to FIG. 4.

The transformer 12 shown in FIG. 1 is an Underwriters Laboratories Inc. (U.L.) Listed Class 2 unit, which meets or exceeds requirements set forth in U.L. Standards 1585 for Class 2 Transformers. In general, a Class 2 unit is any portable power unit under 60 watts (W), which is usually evident from its electrical cord. The Class 2 unit is often used for incandescent and LED lamps, solenoid coil and bell ringing circuits, and may have a single or multiple output circuit with secondary circuit protection. The Class 2 unit is powered by alternating current voltages of 120VAC, 208/240VAC or 277/480VAC, and will output direct current voltages of 12VDC or 24VDC.

In the example shown in FIG. 1, the transformer 12 is a low voltage system, less than about 120 VDC. More particularly the transformer 12 is approximately between about 20W to about 60W maximum. The purpose of the transformer 12 is to "step down" typical household power of 120VAC for use by the plurality of lamp holders 34*a*–*d*. For example, assuming 120VAC, 60 hertz (Hz), 0.5 ampere (A) input to the transformer 12, a single circuit of about 11.5VAC, 60W is output from the transformer 12. Moreover, the transformer 12 may have an electrical protection system (EPS) that limits it to 60W by a built-in circuit breaker.

Figure 2:
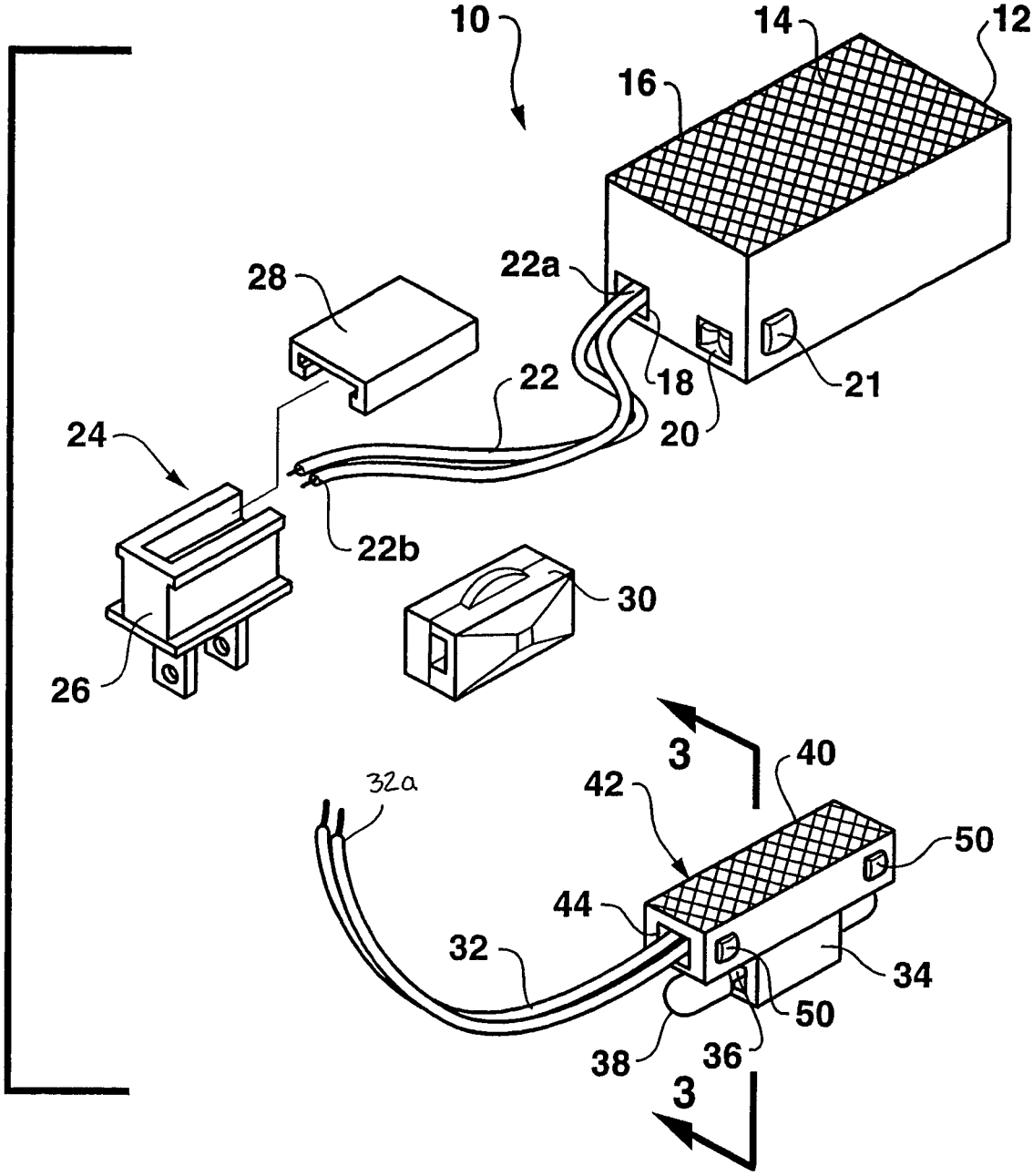
FIG. 2 is a partial, top perspective, exploded view of the luminaire assembly of FIG. 1.

The transformer 12 has a supply aperture/quick-release fitting 18 and an output aperture/quick-release fitting 20, as shown in FIGS. 1 and 2. The transformer 12 is connected to the 120VAC electrical source via the quick-release fitting 18, an electrical input wire 22, and the electrical plug component 24. Similarly, the quick-release fitting 20 connects the transformer 12 to at least one lamp holder 34*a*. The quick-release fittings 18 and 20 are described in greater detail below. Although a variety of transformers may be used as the transformer 12, a suitable transformer is available from Hatch Transformers, Inc. of Tampa, Fla.

Since transformer wattage is determined as a function of the number of lamp holders and electrical wire gauge, specific applications may require a transformer with a rating other than as described above. Accordingly, in another embodiment of the present invention, the component parts of the luminaire assembly 10 are provided separately, or as a "kit" tailored to specific requirements. For example, the luminaire assembly 10 described above is provided with up to six (6) lamp holders 34 having a total of twelve (12) bulbs 38 (FIG. 2). If additional lamp holders or lamp holders with greater bulb capacities (e.g., above 5W) are contemplated, larger gauge wire and larger capacity transformers may be provided, although specific applications and local electric codes may require Class 1 hard wiring.

The lamp holder 34*a* is attached to the transformer 12 by an electrical lead wire 32, as shown in FIGS. 1 and 2. Additional lamp holders 34*b*–*d* are linked to the lamp holder 34*a* and to each other by a plurality of lamp holder lead wires 52*a*–*c*. Each of the wires 32 and 52*a*–*c* may be attached via quick-release fittings 44, as described in detail below with respect to FIG. 2. Alternatively, one or more of the wires 32 and 52*a*–*c* may be provided as permanent parts of one or more of the lamp holders 34*a*–*d*. For instance, lead wire 32 may be permanently attached at one end to the lamp holder 34*a* for subsequent insertion of its free end in the output aperture 20 of the transformer 12. Alternatively, lead wire 32 may be provided as a stand-alone wire for later insertion in both the transformer 12 and the lamp holder 34*a*. As shown in FIG. 1, the various electrical wires 22, 32 and 52*a*–*c* permit the transformer 12 and the plurality of lamp holders 34*a*–*d* to be oriented in straight or non-linear arrangements to accommodate irregular or tight spaces. As noted, it should be understood that although FIG. 1 shows four lamp holders 34*a*–*d*, fewer or additional lamp holders may be provided.

An exploded view of a portion of the luminaire assembly 10 of FIG. 1 is shown in FIG. 2. As described above, both the supply aperture/quick-release fitting 18 and the output aperture/quick-release fitting 20 are quick-connect/quick-release push-in wiring terminals. Electrical wire 22 has an input end 22*a*, as shown in FIG. 2. An outer insulation covering made, for instance, of plastic is stripped to expose a conductive metal lead on the input end 22*a*, as is shown on the opposite end 22*b* of the electrical wire 22. More specifically, the illustrated input wire 22 is approximately 8 inches long and rated as SPT-2#18AWGx2C (gauge), 105° C., for the 120VAC power supply. The input wire 22 is cut to any desired length and has solid or twisted-and-over-tinned leads that are stripped ⅜ inch to be "stabbed" into and captured by the fitting 18. Similarly, the lead wire 32 and wires 52*a*–*c* (FIG. 1) are approximately 12 inches long and rated as #16 gauge, 105° C., to supply the 12VDC power from the transformer 12 to the lamp holders 34*a*–*d*. In addition to stripped conductive leads, or alternatively, some or all of the wires 22, 32, 52*a*–*c* may terminate in male telephone-type plugs, jacks, pins or the like for respective insertion in the fittings 18, 20, and 44, as described below.

The quick-release fitting 20 may have a detent or connector spring that defines a spring constant, as shown in FIG. 2. A stripped end 32*a* of the lead wire 32 is stabbed into the quick-release fitting 20 and held by the spring constant. As described above, the fitting 18 receives the end 22*a* of the wire 22 in a similar push-pull or stab-fit manner. Thus, the wires 22 and 32 are captured by their respective fittings 18 and 20 and held by spring constants until quickly released. Although a detent is used as fittings 18 and 20 in this embodiment, any quick-release female mechanism, such as, but not limited to, a plurality of pressure plates, leaf springs, an aperture having a plurality of capture teeth disposed circumferentially about the aperture, or similar fittings and connectors may be used. The female fittings 18 and 20 and male wires 22 and 32 may be interchangeable. For example, the wires 22 and 32 may be provided with female terminals, and the fittings 18 and 20 may be provided with male leads for respective insertion in the female terminals.

To release the lead wire 32 from the quick-release fitting 20, a quick-release button 21 is provided with the transformer 12. By pressing the button 21, the spring constant of the quick-release fitting 20 is temporarily neutralized to release the end 32*a* of the electrical wire 32. A similar quick-release button (not shown) is provided on the transformer 12 to quickly release the electrical wire 22 from the quick-release fitting 18.

As shown in FIGS. 1 and 2, the electrical plug 24 has a prong component 26 and a cable piercer component 28. The electrical plug 24 and cable piercer component 28 are rated for 120VAC. As shown, once the end 22*b* of the wire 22 is positioned in the prong component 26, the cable piercer component 28 slides or snaps on the prong component 26 to pierce the end 22*b* with metallic blades or teeth (not shown) located on an underside of the component 26 to establish an electrical circuit.

A rotary switch 30 is shown in FIGS. 1 and 2. The rotary switch 30, for example, is U.L. Listed 6A-1025V with a built-in electrical cable piercer (not shown). The cable piercer of the rotary switch 30 operates in a manner similar to the cable piercer component 28 to establish an electrical connection with a portion of the wire 22. In this embodiment, the rotary switch 30 functions as a rheostat. Once the rotary switch pierces the wire 22, the rheostat function of the rotary switch 30 permits the luminaire assembly 10 to be selectively dimmed and brightened by adjusting resistance in the electrical circuit. As the resistance is increased, electrical current is decreased and likewise, power output (W) is decreased to dim a lamp or bulb 38. It should be noted that the electrical plug 24, the prong component 26 and the cable piercer component 28, as well as the rotary dimmer switch 30, may be provided as a unitary device, or as modular components as described above.

Figure 3:
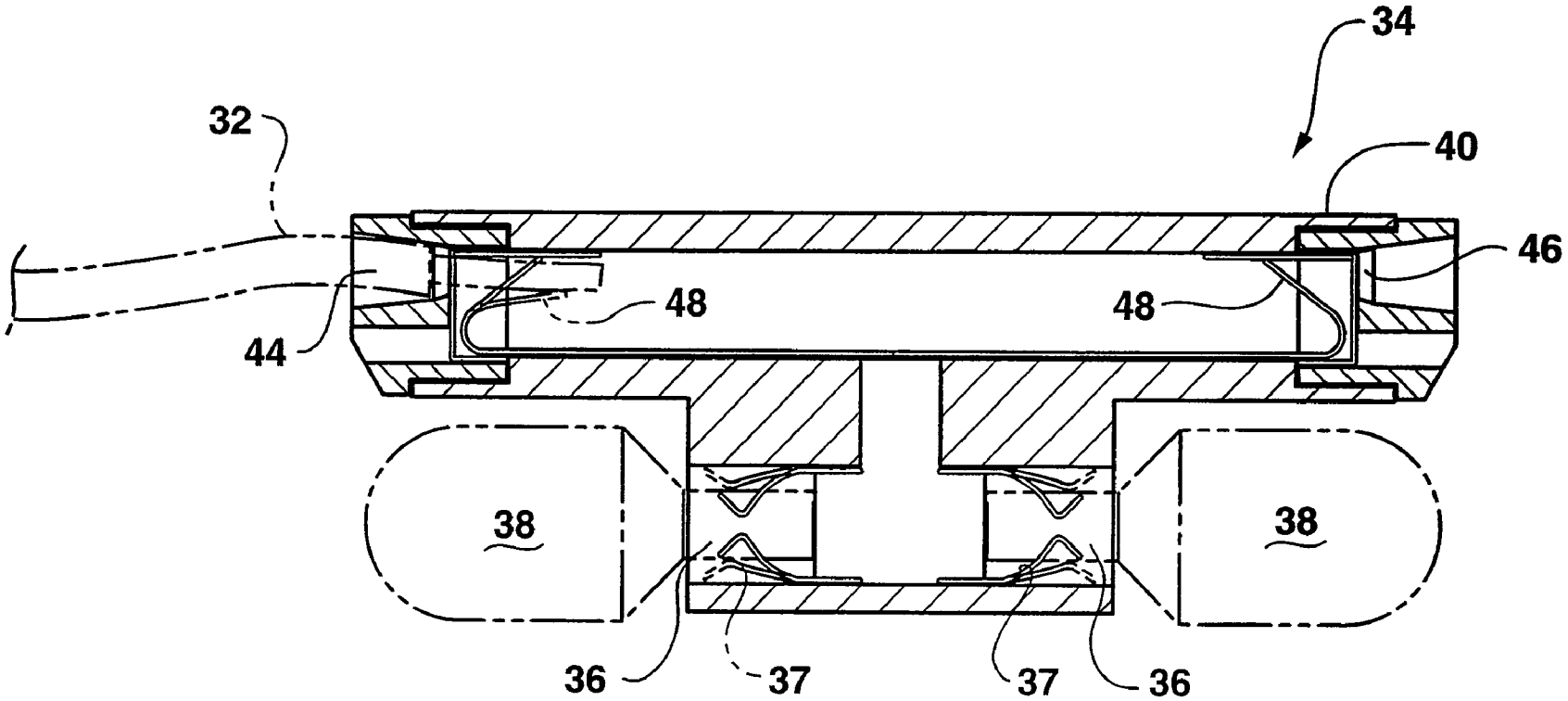
FIG. 3 is a cross-sectional view of a lamp holder taken along line 3—3 of FIG. 2.

The lamp holder 34 is preferably made in part of Noryl® brand, SE-1 plastic (105° C. U.L. rating 28V, 37.5W), available from General Electric Company. The lamp holder 34 has the supply aperture 44 and an output aperture 46 for attachment of the electrical wires 32 and 52*a–d*. A plurality of bulb receptacles 36 in the lamp holder receive a plurality of bulbs 38. The receptacles 36 are provided with corrosion-resistant contacts, such as a retaining spring 37 for retention of the bulbs 38. In this embodiment, the bulbs 38, shown in phantom in FIG. 3, are releasably held by a spring constant of the retaining springs 37. A preferred bulb 38 is a wedge-base xenon lamp, which is approximately about 2W to about 10W, more particularly about 5W maximum, which does not exceed the maximum wattage of the transformer 12. Other types of bulb bases and retention mechanisms may be substituted for the foregoing example. For instance, incandescent, fluorescent, halogen, neon, and other similar lamps may be substituted for xenon. A cylindrically shaped, screw-in bulb base with a complementary receptacle may also be suitably substituted for the wedge-base.

As shown in FIG. 3, corrosion-resistant wire guides and retaining springs 48 are located near the supply aperture 44 and the output aperture 46 for releasable attachment of the electrical wires 32 and 52*a–c*. Similar to the foregoing description regarding the input end 22*a* of the wire 22 and the quick-release fitting 18, ends of the electrical wire 32 and 52*a–d* are respectively stabbed into the lamp holder 34 via the supply aperture 44 and the output aperture 46, captured by the retaining springs 48 and held by a spring constant. Also similar to the description of button 21 above, by pressing quick-release buttons 50 (see FIG. 2), the spring constant of retaining springs 48 may be temporarily overcome to release the electrical wires 32 and 52*a–c*. Although two receptacles 36 positioned opposite one another are shown in FIGS. 1–4, other orientations and fewer or additional receptacles 36 may be provided in the lamp holders 34. A suitable compact, low profile lamp holder for use as a lamp holder 34 is available from Hatch Transformers, Inc. of Tampa, Fla., although any suitable lamp holder may be used.

Figure 4:
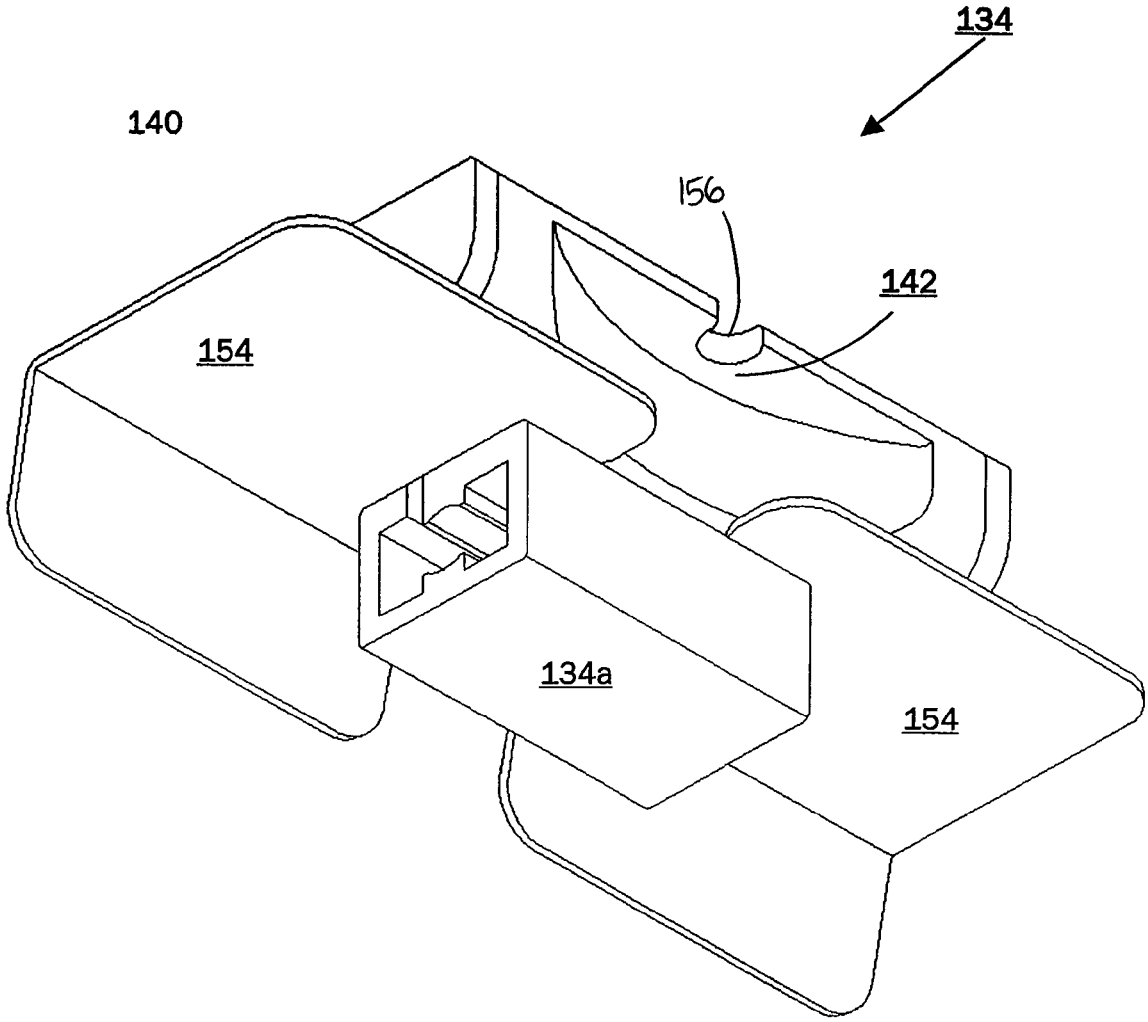
FIG. 4 is a perspective view of a lamp holder according to a second embodiment of the present invention.

A lamp holder assembly 134 according to a second embodiment of the present invention includes a lamp holder 134*a* and a mounting assembly 140 for attaching the lamp holder assembly 134 to a surface area, as shown in FIG. 4. In this embodiment, the mounting assembly 140 defines a securement part 142 having an arcuate opening 156 therein that receives a screw, bolt, nail, rivet, pin and the like to secure the lamp holder assembly 134 to the surface area. A guide piece 154 is also provided to flush-mount the lamp holder assembly 134 in a surface area corner or along an edge of a wall. It is to be noted that various other shapes and orientations of the foregoing elements may be provided and such variations and modifications are within the scope of the invention. Also, similar securement parts and guide pieces may be provided to mount the transformer 12.

The invention may be better understood with reference to the following embodiments of operations and methods of using the present invention.

In one embodiment of the invention, a method for installing the low-voltage luminaire assembly 10 is provided. With reference to FIGS. 1–3, the method includes the steps of providing a low-voltage luminaire assembly kit having a plurality of lamp holders 34*a–d* and a transformer 12. At least two of the plurality of lamp holders 34*a–d* are linked via lead wires 52*a–c*. The at least two lamp holders 34*a–d* are attached to an object or area (not shown). The transformer 12 is attached to the object or area, A lead wire 32 is connected from one of the lamp holders 34*a–d* to the transformer 12. The transformer 12 is connected to a source of electrical power (not shown).

The method of this embodiment may include further steps, such as, but not limited to, the following steps. A length of lead wire 32 and 52*a–c* required between each lamp holder 34*a–d* is measured. A lead wire 32,52*a–c* is then cut to the required length. An electrical plug component 24 is attached to the transformer 12 to connect the transformer 12 to the electrical power source. A dimmer switch 30 may be attached proximate the electrical plug component 24. The dimmer switch 30 may be configured to selectively adjust a resistance in an electrical circuit between the electrical plug component 24 and the transformer 12. A lamp 38 is inserted in one of the lamp holders 34*a–d*. The wire 32 and 52*a–c* may be routed in a non-linear orientation. Moreover, an aesthetic covering (not shown) of any color, shape or material can be provided to cover the wires 32 and 52*a–c*.

In another embodiment of the invention, a method for servicing the luminaire assembly 10 is provided. In this embodiment, the steps include disconnecting the luminaire assembly 10 from a source of electrical power (not shown). The electrical wires 22, 32 and 52*a–c* are released from one of a transformer 12 and a lamp holder 34 via quick-release connections 18, 20 and 44. One of the transformer 12 and lamp holders 34*a–d* is removed from an installation area (not shown). One of a new transformer (not shown but similar to 12) and a new lamp holder (not shown but similar to 34*a–d*) is attached in the installation area. The electrical wires are reinserted in one of the newly attached transformer and the new lamp holder. The luminaire assembly is then reconnected to the electrical power source.

The foregoing method may include additional steps such as, but not limited to, the following steps. Additional lamp holders (not shown but similar to 34*a–d*) are attached to the luminaire assembly 10. The transformer 12 is replaced with a higher rated transformer (not shown but similar to 12). A position of one of the transformer and the lamp holders is adjusted. A plurality of bulbs 38 may be removed or inserted. In the event the original adhesive tape 16, 42*a–d* is unusable, the transformer and lamp holders may be repositioned using another adhesive, a screw, a bolt, a nut, a rivet, a nail, a pin, a snap-fitting, a press-fitting, or any other suitable fastening means.

While advantageous embodiments have been chosen to illustrate the invention, it will be understood by those skilled in the art that various changes and modifications can be made therein without departing from the scope of the invention as defined in the appended claims.

What is claimed is:

1. A lighting assembly, comprising:

a lamp holder having an electrical power supply push-in wiring terminal and an electrical power output push-in wiring terminal, said electrical power supply push-in and output push-in wiring terminals adapted for respectively connecting and disconnecting an electrical power supply wire and an electrical power output wire to said lamp holder;

wherein each of said push-in wiring terminals includes a movable member adapted to releasably retain an inserted wire and an activating member adapted to move said movable member to release the wire such that the inserted wire is quickly released from said push-in wire terminal.

2. The lighting assembly as in claim 1, wherein said lamp holder has a mountable side adapted for mounting said lamp holder to an object.

3. The lighting assembly as in claim 2, wherein said mountable side is mountable by selecting from the group consisting of an adhesive, an adhesive tape, a screw, a bolt, a nut, a snap-fitting, a press-fitting, a rivet, a nail, a pin, and combinations thereof.

4. The lighting assembly as in claim 1, wherein said movable member is a leaf spring and said activating member is a button adapted to move said leaf spring to quickly release the inserted wire.

5. The lighting assembly as in claim 1, wherein a transformer has an output connector, said output connector adapted to connect to said electrical power supply connector of said lamp holder with a lead wire.

6. The lighting assembly as in claim 5, wherein said transformer includes a mountable side adapted to mount said transformer to an object.

7. The lighting assembly of claim 6, wherein said mountable side is mountable by selecting from the group consisting of an adhesive, an adhesive tape, a screw, a bolt, a nut, a rivet, a nail, a pin, a snap-fitting, a press-fitting, and combinations thereof.

8. The lighting assembly as in claim 5, wherein said transformer has an electrical protection system.

9. A light assembly comprising:

a transformer having an electrical power supply push-in wiring terminal and an electrical power output push-in wiring terminal, said electrical power supply and output wiring terminals adapted for respectively connecting and disconnecting an electrical power supply wire and an electrical power output wire to said transformer;

wherein each of said push-in wiring terminals includes a movable member adapted to releasably retain an inserted wire and an activating member adapted to move said movable member to release the wire such that the inserted wire is quickly released from said push-in wiring terminal.

10. The lighting assembly as in claim 9, wherein said transformer has an electrical protection system.

11. The lighting assembly of claim 9, wherein said transformer has a mountable side adapted for mounting said transformer to an object.

12. The lighting assembly of claim 11, wherein said mountable side is mountable by selecting from the group consisting of an adhesive, an adhesive tape, a screw, a bolt, a nut, a rivet, a nail, a pin, a snap-fitting, a press-fitting, and combinations thereof.

13. The lighting assembly as in claim 9, wherein said electrical power supply push-in and output wiring terminals are adapted for quickly releasing a wire.

14. The lighting assembly as in claim 9, wherein a lamp holder has an input connector, said input connector adapted to be connected to said electrical power output wiring terminal of said transformer with a lamp holder lead wire.

15. The lighting assembly as in claim 14, wherein said lamp holder is adapted to be connected to another lamp holder with another lamp holder lead wire.

16. The lighting assembly as in claim 14, wherein said lamp holder has a mountable side adapted to mount said lamp holder to an object.

17. The lighting assembly as in claim 16, wherein said mountable side is mountable by selecting from the group consisting of an adhesive, an adhesive tape, a screw, a bolt, a nut, a rivet, a nail, a pin, a snap-fitting, a press-fitting, and combinations thereof.

18. A low voltage luminaire assembly comprising:

a transformer having a power supply fitting and a power output fitting, said supply and output fittings being push-in wire connectors and adapted to respectively connect an end of an electrical power supply wire and an end of an electrical power output wire to said transformer, said supply and output fittings adapted for quick-release of said respective ends of said electrical power supply and output wires, said electrical power supply wire adapted to connect said transformer to an electrical power supply; and a lamp holder having an electrical power supply connector and an electrical power output connector, said supply connector being a push-in wire connector and adapted for attachment of an opposing end of said electrical power output wire, said output connector being a push-in wire connector and adapted for attachment of another electrical power supply wire, said lamp holder adapted to receive a lamp;

wherein each of said push-in wire connectors includes a movable member adapted to releasably retain an inserted wire and an activating member adapted to move said movable member to release the wire such that the inserted wire is quickly released from said push-in wire connector.

19. The low voltage luminaire assembly of claim 18, wherein said transformer has an electrical protection system.

20. The low voltage luminaire assembly of claim 18, wherein said transformer is rated for between about 20 watts to about 60 watts.

21. The low voltage luminaire assembly of claim 18, wherein said transformer is adapted to receive about 120VAC and to output from about 11VDC to about 12VDC.

22. The low voltage luminaire assembly of claim 18, wherein said transformer includes a mountable side adapted to mount said transformer to an object.

23. The low voltage luminaire assembly of claim 22, wherein said mountable side is mountable by selecting from the group consisting of an adhesive, an adhesive tape, a screw, a bolt, a snap-fitting, a press-fitting, a rivet, a nail, and combinations thereof.

24. The low voltage luminaire assembly of claim 18, wherein said push-in wire connectors are corrosion resistant.

25. The low voltage luminaire assembly of claim 18, wherein said supply wire is rated for about 120VAC.

26. The low voltage luminaire assembly of claim 18, wherein an electrical plug component is connected to said electrical power supply wire.

27. The low voltage luminaire assembly of claim 26, wherein said electrical plug component is adapted to pierce said electrical power supply wire.

28. The low voltage luminaire assembly of claim 18, further comprising a dimmer switch connected to said electrical power supply wire.

29. The low voltage luminaire assembly of claim 28, wherein said dimmer switch is adapted to pierce said electrical power supply wire.

30. The low voltage luminaire assembly of claim 18, wherein said lamp holder includes a second mountable side adapted for mounting said lamp holder to an object.

31. The low voltage luminaire assembly of claim 30, wherein said second mountable side is mountable by selecting from the group consisting of an adhesive, an adhesive tape, a screw, a bolt, a nut, a rivet, a nail, a pin, a snap-fitting, a press-fitting, and combinations thereof.

32. The low voltage luminaire assembly of claim 18, wherein said movable member is selected from the group consisting of a connector spring, a detent, a pressure plate, a leaf spring, an aperture defining capture teeth and combinations thereof.

33. The low voltage luminaire assembly of claim 32, wherein said activating member is a quick-release button.

34. The low voltage luminaire assembly of claim 18, wherein said lamp is selected from the group consisting of an incandescent lamp, a xenon lamp, a fluorescent lamp, a neon lamp, a halogen lamp, and combinations thereof.

35. The low voltage luminaire assembly of claim 18, wherein said lamp holder is a plurality of lamp holders.

36. A method for installing a low voltage luminaire assembly, comprising the steps of:

providing a low voltage luminaire assembly kit having a lamp holder and a transformer;

attaching the lamp holder to an area;

attaching the transformer to the area; and connecting a lead wire from the lamp holder to a capture and push-in wiring quick-release fitting of the transformer, the capture and push-in wiring quick-release fitting including a movable member adapted to releasably retain the inserted wire and an activating member adapted to move said movable member to release the inserted wire such that the inserted wire is quickly released from said capture and push-in wiring quick-release fitting.

37. The method as in claim 36, wherein attaching the lamp holder comprises attaching a plurality of lamp holders.

38. The method as in claim 37, further comprising linking at least two of the lamp holders via a lead wire.

39. The method as in claim 36, further comprising connecting the transformer to a source of electrical power.

40. The method as in claim 38, further comprising measuring a length of the lead wire required between each lamp holder.

41. The method as in claim 40, further comprising cutting the lead wire to the required length.

42. The method as in claim 36, further comprising mounting the lamp holder and the transformer by selecting from the group consisting of an adhesive, an adhesive tape, a screw, a bolt, a nut, a rivet, a nail, a pin, a snap-fitting, a press-fitting, and combinations thereof.

43. The method as in claim 39, further comprising attaching an electrical plug component to the transformer to connect the transformer to the electrical power source.

44. The method as in claim 43, further comprising attaching a dimmer switch proximate the electrical plug component, the dimmer switch adapted to selectively adjust a resistance in an electrical circuit between the electrical plug component and the transformer.

45. The method as in claim 36, wherein connecting the lead wire to the capture and quick-release fitting of the transformer comprises connecting the lead wire to the movable member of the capture and quick-release fitting that is selected from the group consisting of a connector spring, a detent, a pressure plate, a leaf spring, an aperture defining capture teeth and combinations thereof.

46. The method as in claim 36, further comprising inserting a lamp in the lamp holder.

47. The method as in claim 36, further comprising routing the lead wire in a non-linear orientation.

48. The method as in claim 36, wherein providing a low voltage luminaire assembly kit having a lamp holder and a transformer comprises providing a transformer having an electronic protection system.

49. The method as in claim 48, wherein providing a transformer having an electronic protection system comprises providing a transformer having a built-in circuit breaker as the electronic protection system.

50. A method for servicing a luminaire assembly, comprising the steps of:

disconnecting the luminaire assembly from a source of electrical power;

releasing electrical wires from one of a transformer and a lamp holder with quick-release push-in wiring connections, each of the quick-release push-in wiring connections including a movable member adapted to releasably retain an inserted wire and an activating member adapted to move said movable member to release the inserted wire such that the inserted wire is quickly released from the quick-release push-in wiring connection;

removing one of the transformer and lamp holder from an installation area;

attaching one of a replacement transformer and another lamp holder in the installation area; and reinserting the electrical wires in the push-in wiring connection in one of the replacement transformer and the another lamp holder.

51. The method as in claim 50, further comprising reconnecting the luminaire assembly to the electrical power source.

52. The method as in claim 50, further comprising replacing the transformer with a higher rated transformer.

53. The method as in claim 50, further comprising adjusting a position of one of the transformer and the lamp holder.

54. The method as in claim 53, wherein adjusting the position comprises adjusting the position by selecting from the group consisting of an adhesive, an adhesive tape, a screw, a bolt, a nut, a rivet, a nail, a pin, a snap-fitting, a press-fitting, and combinations thereof.

55. The method as in claim 43, further comprising removing or inserting a plurality of bulbs.

* * * * *